US012349815B2

(12) United States Patent
Bates et al.

(10) Patent No.: US 12,349,815 B2
(45) Date of Patent: Jul. 8, 2025

(54) CONFIGURATION FOR A HEAT EXCHANGER IN A TEMPERATURE CONTROLLED CASE

(71) Applicant: Hill Phoenix, Inc., Conyers, GA (US)

(72) Inventors: Roy Bates, Chesterfield, VA (US); Lawrence W. Eget, Mechanicsville, VA (US); Karuna Kumari Lade, Glen Allen, VA (US)

(73) Assignee: Hill Phoenix, Inc., Conyers, GA (US)

( * ) Notice: Subject to any disclaimer, the term of this patent is extended or adjusted under 35 U.S.C. 154(b) by 0 days.

(21) Appl. No.: 18/451,689

(22) Filed: Aug. 17, 2023

(65) Prior Publication Data

US 2024/0041228 A1 Feb. 8, 2024

Related U.S. Application Data

(63) Continuation of application No. 16/173,462, filed on Oct. 29, 2018, now abandoned.
(Continued)

(51) Int. Cl.
*A47F 3/04* (2006.01)
*F25B 39/04* (2006.01)
(Continued)

(52) U.S. Cl.
CPC ..... *A47F 3/0408* (2013.01); *A47F 3/0443* (2013.01); *A47F 3/0478* (2013.01);
(Continued)

(58) Field of Classification Search
CPC .... A47F 3/0408; A47F 3/0443; A47F 3/0478; F25B 39/04; F25B 49/02; F25B 49/027;
(Continued)

(56) References Cited

U.S. PATENT DOCUMENTS 2,513,675 A 7/1950 Albert
3,103,796 A * 9/1963 Dickson ..... F25D 21/06 62/275

(Continued)

FOREIGN PATENT DOCUMENTS

WO WO 2008/013546 1/2008

OTHER PUBLICATIONS hvacrschool.com [online], "What You Need to Know About Microchannel," available on or before Feb. 19, 2018, via Internet Archive: Wayback Machine URL <http://web.archive.org/web/20200508210729/https://www.hvacrschool.com/need-know-microchannel/>, retrieved on Mar. 2, 2023, URL <https://hvacrschool.com/need-know-microchannel/>, 4 pages.

(Continued)

*Primary Examiner* — Travis Ruby
(74) *Attorney, Agent, or Firm* — Fish & Richardson P.C.

(57) ABSTRACT

A heat exchanger for a temperature controlled case is disclosed herein. A temperature controlled case includes a housing that defines a temperature controlled space. The housing includes a duct that receives circulated air. A heat exchanger is coupled to the housing and disposed within the duct. The heat exchanger includes an intake face at a non-perpendicular angle relative to an air flow direction in the duct immediately upstream of the heat exchanger.

17 Claims, 6 Drawing Sheets

Related U.S. Application Data

(60) Provisional application No. 62/584,231, filed on Nov. 10, 2017.

(51) Int. Cl.
*F25B 49/02* (2006.01)
*F25D 11/00* (2006.01)

(52) U.S. Cl.
CPC ..... *F25B 39/04* (2013.01); *F25B 49/02* (2013.01); *F25B 49/027* (2013.01); *F25D 11/00* (2013.01); *F25B 2400/22* (2013.01)

(58) Field of Classification Search
CPC ..... F25B 2400/22; F25B 2500/01; F25B 2500/17; F25D 11/00; F25D 17/067; F25D 23/006; F25D 2317/0671
See application file for complete search history.

(56) References Cited

U.S. PATENT DOCUMENTS

| | | | | |
|---|---|---|---|---|
| 3,561,230 | A | 2/1971 | Gatton et al. | |
| 4,577,467 | A * | 3/1986 | Ibrahim | F25D 21/12 165/146 |
| 5,031,413 | A | 7/1991 | Tsuihiji et al. | |
| 5,074,122 | A | 12/1991 | Babin et al. | |
| 5,086,627 | A | 2/1992 | Borgen | |
| 5,282,367 | A | 2/1994 | Moore et al. | |
| 5,662,394 | A | 9/1997 | Choi | |
| 5,675,983 | A | 10/1997 | Ibrahim | |
| 5,678,421 | A | 10/1997 | Maynard et al. | |
| 6,272,876 | B1 | 8/2001 | Roberts et al. | |
| 6,519,962 | B1 | 2/2003 | Schuetter | |
| 6,722,149 | B1 | 4/2004 | Saroka et al. | |
| 7,681,409 | B2 | 3/2010 | Alahyari et al. | |
| 8,359,876 | B2 | 1/2013 | Esformes | |
| 8,863,541 | B2 | 10/2014 | Swofford et al. | |
| 9,526,354 | B2 | 12/2016 | Barreto et al. | |
| 9,560,921 | B2 | 2/2017 | Resch | |
| 9,675,185 | B2 | 6/2017 | Anderson et al. | |
| 2001/0003248 | A1 | 6/2001 | Otto et al. | |
| 2002/0184904 | A1 | 12/2002 | Wellman | |
| 2006/0196208 | A1 | 9/2006 | Zangari et al. | |
| 2006/0207281 | A1 | 9/2006 | Suda et al. | |
| 2007/0295492 | A1 | 12/2007 | Sharp | |
| 2009/0084124 | A1 | 4/2009 | Hayase | |
| 2009/0255287 | A1 | 10/2009 | Alahyari et al. | |
| 2010/0064712 | A1 | 3/2010 | Esformes | |
| 2011/0259031 | A1 | 10/2011 | Anderson et al. | |
| 2013/0019625 | A1 | 1/2013 | Bryce | |
| 2013/0213073 | A1 | 8/2013 | Fritz et al. | |
| 2015/0295285 | A1* | 10/2015 | Takeuchi | B60L 1/02 62/498 |
| 2016/0278542 | A1 | 9/2016 | Eget et al. | |
| 2019/0142185 | A1 | 5/2019 | Bates et al. | |

OTHER PUBLICATIONS

Kaltra, "Microchannel Evaporators: Heat Exchangers for Evaporator Applications," English Technical Manual, 2020, 26 pages.
Office Action in Mexican Appln. No. MX/A/2018/013575, dated Jul. 5, 2022, 8 pages (with English translation).
Office Action in Mexican Appln. No. MX/A/2018/013575, mailed Feb. 7, 2023, 10 pages (with Machine Translation).
Office Action in Mexican Appln. No. MX/a/2022/006815, mailed Aug. 17, 2023, 12 pages (with Machine Translation).
Office Action in Mexican Appln. No. MX/a/2022/006815, mailed May 16, 2023, 8 pages (with Machine Translation).
Office Action in Mexican Appln. No. MX/a/2022/006816, mailed Aug. 18, 2023, 14 pages (with Machine Translation).
Office Action in Mexican Appln. No. MX/a/2022/006816, mailed May 16, 2023, 10 pages (with Machine Translation).
QLV7V—Reach in Eliminator Door, http://www.kysorwarren.com/files/literature/merchandisers/KW-SS-QLV7V-Eliminator-LT.pdf, Feb. 23, 2012, 1 page.
RHZC30 Low Temp Reach in, https://www.zero-zone.com/includes/loadFile.php?GID=100e4867be729ddebaf074550555899a, May 17, 2017, pp. 1-2.
RVLC30 Low Temp Reach Ins, https://www.zero-zone.com/includes/loadFile.php?GID=50ec1 f1a137d284748c21 c3283992674, Sep. 8, 2017, pp. 1-2.
Office Action in Canadian Appln. No. 3,023,006, mailed Apr. 23, 2025, 5 pages.

* cited by examiner

CONFIGURATION FOR A HEAT EXCHANGER IN A TEMPERATURE CONTROLLED CASE

CROSS-REFERENCE TO RELATED APPLICATIONS

This application is a continuation application of and claims priority under 35 U.S.C. § 120 to U.S. application Ser. No. 16/173,462, filed on Oct. 29, 2018, which claims the benefit of and priority to U.S. Provisional Application No. 62/584,231 filed Nov. 10, 2017 and entitled "Configuration for a Heat Exchanger in a Temperature Controlled Case," the entire contents of each of which are incorporated herein by reference.

TECHNICAL FIELD

The present disclosure relates to a cooling system for a temperature controlled case. More specifically, the present disclosure relates to a configuration of a heat exchanger for a cooling system for a temperature controlled case.

BACKGROUND

Temperature controlled cases are used for the storage, preservation, and presentation of products, such as food products including perishable meat, dairy, seafood, produce, etc. To facilitate the preservation of the products, temperature controlled cases often include one or more cooling systems for maintaining a display area of the case at a desired temperature. The one or more cooling systems may include one or more cooling elements (e.g., cooling coils, heat exchangers, evaporators, fan-coil units, etc.) through which a coolant or refrigerant is circulated (e.g., a liquid such as a glycol-water mixture, etc.) to provide cooling to an internal cavity of the case (a temperature controlled space or area). As a result of the cooling, the food products or other stored items are typically maintained in a chilled state.

Temperature controlled spaces exist in many different form-factors (shapes, cross-sections, etc.) tailored to meet specific display goals. For instance, some temperature controlled spaces may have a single display deck, and be substantially open at a top horizontal plane in order to enable the placement or removal of product(s). Other temperature controlled spaces may have additional display tiers (for example, shelves or peg hooks) disposed in a generally vertical plane. Still other temperature controlled spaces may have a temperature controlled space that is oriented in a plane that is at an angle relative to vertical and horizontal planes through which products are removed or restocked. Any of these temperature controlled spaces may be open to the ambient air or selectively covered/blocked via one or more doors. Regardless of the spatial geometry of the temperature controlled space, a barrier is needed to separate the ambient surroundings and the temperature controlled space.

Cooling systems commonly circulate refrigerated air in order to both remove heat from the temperature controlled space and to establish a protective air-curtain barrier between the temperature controlled space and the ambient surroundings. The moving air is warmed as the air transits the temperature controlled space. Typically, this heat is then transferred to a tube and fin heat-exchanger in hidden, non-shopped areas of the temperature controlled case. It is desirable to minimize the functional, hidden, utilitarian areas of the temperature controlled case in order to increase product storage capacity and provide better aesthetic appeal. However, minimization of the hidden, non-shopped areas may create performance limitations that render the temperature controlled case undesirable for one or more intended purposes. For example, temperature controlled cases designed for broader application ranges or adverse ambient conditions constrain the size of the hidden, non-shopped areas, which may render the temperature controlled case undesirable for an intended merchandising display. Accordingly, there is a need for an improved heat exchanger that can overcome these limitations and retain superior refrigeration performance while reducing the hidden, utilitarian areas of the equipment.

SUMMARY

One embodiment relates to a temperature controlled case including a housing that defines a temperature controlled space, the housing including a duct that receives circulated air; and, a heat exchanger coupled to the housing and disposed within the duct, the heat exchanger including an intake face at a non-perpendicular angle relative to an air flow direction in the duct immediately upstream of the heat exchanger.

Another embodiment relates to a heat exchanger for a cooling system for a temperature controlled case. The heat exchanger includes a cooling coil; and, a plurality of heat exchange fins coupled to the cooling coil. In one configuration, the coupled cooling coil and plurality of heat exchanges fins form a rectangular body having a primary intake face for receiving air that exchanges heat with the cooling coil, wherein the primary intake face is disposed at a non-perpendicular angle relative to a plane that is perpendicular to a direction of air flow immediately upstream of the heat exchanger.

Still another embodiment relates to a temperature controlled case. The temperature controlled case includes a housing that defines a temperature controlled space, the housing including a duct that receives circulated air; and a heat exchanger coupled to the housing and disposed within the duct, the heat exchanger including an intake face having a cross-sectional dimension greater than a cross-sectional dimension of the duct.

DETAILED DESCRIPTION

Figure 1:
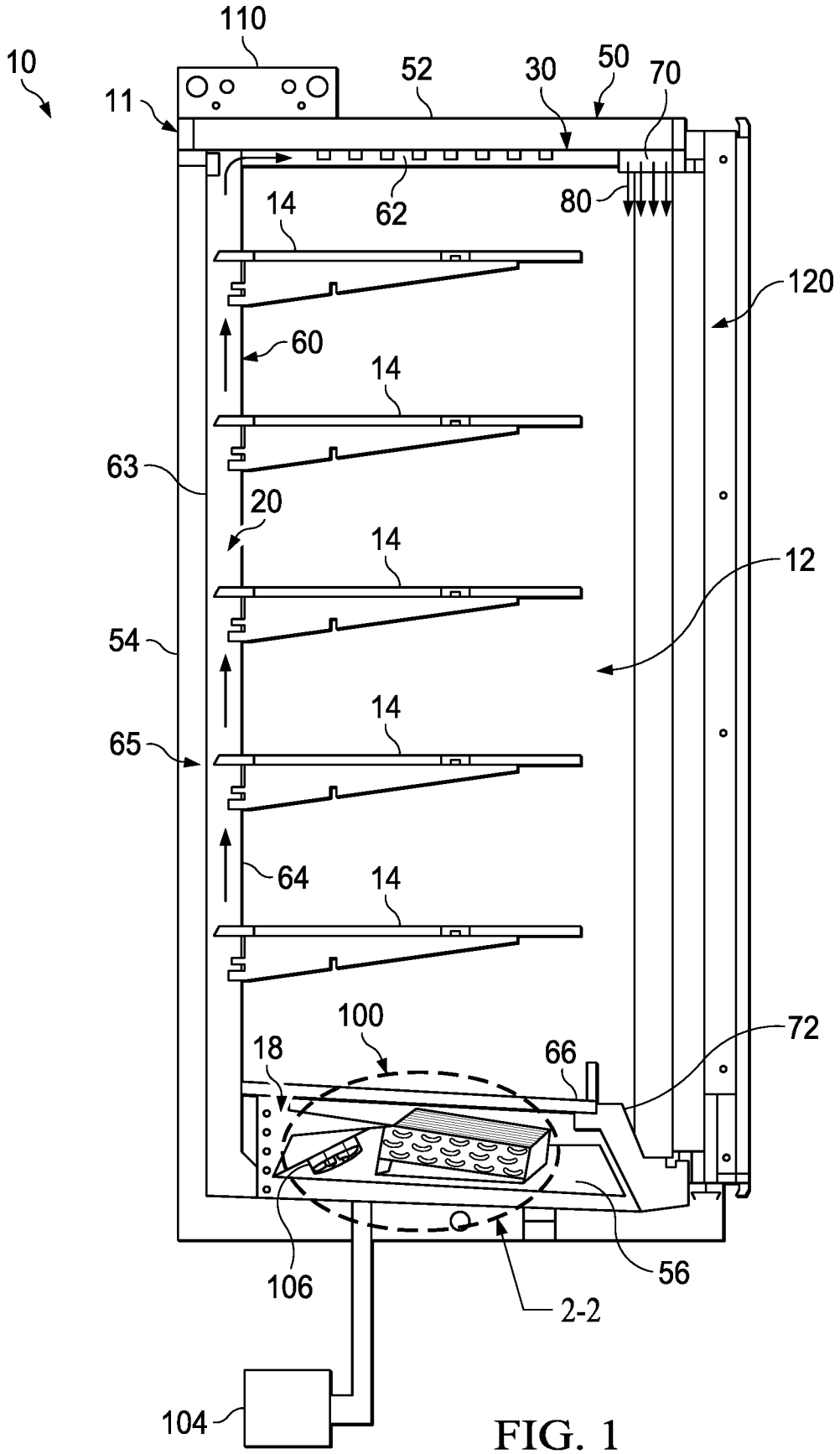
FIG. 1 is a side cross-sectional view of a vertically-oriented temperature controlled case with a heat exchanger used in a cooling system of the temperature controlled case, according to an exemplary embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the Figures generally, various embodiments disclosed herein relate to a heat exchanger configuration for a temperature controlled case. In certain temperature controlled cases, air is circulated to maintain a desired temperature of a temperature controlled space. In operation, the circulated air transits the temperature controlled space whereby the air absorbs heat from the space to, in turn, cool the temperature controlled space. One or more heat exchangers are utilized to remove the heat absorbed by the circulated air before the air is then recirculated back through the temperature controlled space. According to the present disclosure, a heat exchanger is disposed in an equipment area, such as a designated duct, of the temperature controlled case, where an intake face of the heat exchanger is at a non-perpendicular angle to the air flow direction immediately upstream of the heat exchanger.

Applicant has determined that this configuration for a heat exchanger may provide several benefits. One benefit is the minimization of non-shopped areas (e.g., the duct containing the heat exchanger or other equipment area), which improves the ratio of usable refrigerated display space to the overall temperature controlled case dimension. In this regard, the size of the heat exchanger and, primarily the size of the intake face of the heat exchanger, is delinked and independent of the cross-sectional duct dimension where the heat exchanger is housed. Beneficially, this delinking provides an ability to reduce the duct dimension yet increase the intake face dimension (i.e., the cross-sectional length of the intake face versus the cross-sectional height or width of the duct) to be greater than the duct dimension. In turn, a dimension of the temperature controlled space may also be increased such that relatively more products may be stored in the temperature controlled case of the present disclosure compared to conventional temperature controlled cases. Another benefit of orienting at least one face of the heat exchanger at a non-perpendicular angle relative to the air flow immediately upstream of the heat exchanger is that such an orientation leads to less consumption of fan energy. This is due to the presence of less static pressure on the fan because of the increase in total intake face area, which results in alternate air paths around frost accumulation in the heat exchanger. As a result, users may experience a cost-savings from using less electricity as well as a prolonged life for the now less-used fan. Relatedly and as a result, defrost cycles may be required relatively less frequently as compared to typical heat exchangers. Further, these defrost cycles may utilize relatively less defrost energy compared to conventional defrost cycles because any accrued frost is thinner as the frost may be more spread out due to the increase in surface area of the intake face compared to conventional heat exchangers. These and other features and benefits are described more fully herein below.

Referring now to FIG. 1, a temperature controlled display device 10 is shown, according to an exemplary embodiment. The temperature controlled display device 10 (also referred to herein as a temperature controlled case and a refrigerated case) may be a refrigerator, a freezer, a refrigerated merchandiser, a refrigerated display case, or other device capable of use in a commercial, institutional, or residential setting for storing and/or displaying refrigerated and/or frozen objects. For example, the temperature controlled display device 10 may be a service type refrigerated display case for displaying fresh food products (e.g., beef, pork, poultry, fish, etc.) in a supermarket or other commercial setting.

As shown, the temperature controlled display device 10 includes a housing 11 that defines a temperature controlled space 12 (also referred to as a refrigerated area, temperature controlled area, or display area), a plurality of shelves 14 for storing and holding products stored within the temperature-controlled space 12, a plurality of ducts or air ducts 18, 20, and 30 defined by the housing 11 for circulating air, a box 110 for electronics (i.e., an electronics box), a cooling system 100, and a door 120. The electronics box 110 may be structured as a junction box for one or more electrically-driven components of the device 10. The electronics box 110 may also be structured to store one or more controllers for one or more components of the device 10. For example, the box 110 may include hardware and/or logic components for selectively activating and deactivating the cooling system 100 to achieve or substantially achieve a desired temperature in the display area 12.

In various embodiments, the temperature controlled display device 10 may be an open-front refrigerated display case or a closed-front display case like shown in FIG. 1. An open-front temperature controlled case may use a flow of chilled air that is discharged across the open front of the case to help maintain a desired temperature within temperature controlled space 12. A closed-front temperature controlled case, like shown in FIG. 1, includes one or more doors, such as a door 120, for accessing food products or other items stored within temperature controlled space 12. The one or more doors may be movable between a first position (a closed position) and a second position (an open position). In the first or closed position, like shown in FIG. 1, the door covers or substantially covers the opening for the temperature controlled space. In the second or position, the door is moved to be spaced apparat from the opening, such that a user may access objects stored within the temperature controlled space. Both types of display cases may also include various openings within the temperature controlled space 12 that are configured to route chilled air from a cooling system 100 to other portions of the respective display case (e.g., via an air mover, such as fan 106).

The cooling system 100 is structured to cool the temperature controlled space 12. In one embodiment, the cooling system 100 is configured as a direct expansion system such as shown in the FIGURES. In other embodiments, the cooling system may be configured as a secondary coolant exchange system or another type of heat exchange system. All such variations are intended to fall within the spirit and scope of the present disclosure. The cooling system 100 includes at least one heat exchanger 150 (e.g. evaporator, cooling coil, fan-coil, evaporator coil, cooling element, etc.) and a unit 104. In the example shown, the unit 104 is structured as a condensing unit or parallel condensing system because the cooling system 100 is structured as a direct heat exchange system. The condensing unit may include any typical component included with condensing units in direct heat exchange systems, such as a compressor, condenser, receiver, etc. In a secondary coolant system, the unit 104 is structured as a chiller (e.g., heat exchanger, etc.). The chiller facilitates heat exchange between a primary refrigerant loop and a secondary coolant loop. The secondary coolant loop includes a cooling element and any other component typically included in the secondary coolant loops of secondary coolant systems. The primary refrigerant loop includes any typical components used in primary refrigerant loops of secondary coolant systems, such as a condenser, compressor, receiver, etc. In either configuration, during a cooling mode of operation, the heat exchanger 150 may operate at a temperature lower than the temperature of the air within the temperature controlled space 12 to provide cooling to the temperature controlled space 12.

For instance and in regard to a direct heat exchange system, during the cooling mode, the heat exchanger 150 may receive a liquid coolant from the condensing unit 104. The liquid coolant may lower the temperature of the heat exchanger 150 below the temperature of the air surrounding the heat exchanger 150 causing the heat exchanger 150 (e.g., the liquid coolant within heat exchanger 150) to absorb heat from the surrounding air. As the heat is removed from the surrounding air, the surrounding air is chilled. The chilled air may then be directed to the temperature controlled space 12 by at least one air mover or another air handling device, shown as the fan 106 in FIG. 1, in order to lower or otherwise control the temperature of the temperature controlled space 12. In a secondary coolant system, the coolant circulates through the heat exchanger 150 but does not expand (change state) within the heat exchanger 150 like in the direct expansion system. Thus, the heat exchanger 150 of the present disclosure may be used with direct expansion refrigerants (e.g., HFC's or natural (CO2, propane, etc.)) and secondary coolant system coolants (e.g., CO2, glycol-water blends, Dynalene, etc.).

As mentioned above, the temperature controlled display device 10 includes a housing 11 and a door 120. The door 120 is movably coupled to the housing 11. As alluded to above, the door 120 is movable from a position furthest from the temperature controlled space 12 (i.e., a full open position) to a position that covers or substantially covers the temperature controlled space 12 (i.e., a full close position). In the full or a partial open position, a user may reach into the display area 12 to access one or more of the products stored therein.

The housing 11 includes cabinets (e.g., shells, etc.) shown as an outer cabinet 50 and an inner cabinet 60 that include one or more walls (e.g., panels, partitions, barriers, etc.). The outer cabinet 50 includes a top wall 52 coupled to a rear wall 54, which is coupled to a bottom wall 56. The bottom wall 56 may be coupled to one or more support structures (e.g., legs, feet, etc.) for the case or movable elements (e.g., wheels, casters, etc.) for enabling the case 10 to be moved. The inner cabinet 60 generally includes a top wall 62 coupled to a rear wall 64 that is coupled to a base wall 66. Coupling between the walls may be via any type of attachment mechanism including, but not limited to, fasteners (e.g., screws, nails, etc.), brazes, welds, press fits, snap engagements, etc. In some embodiments, the inner and outer cabinets 60 and 50 may each be of an integral or uniform construction (e.g., molded pieces). In still further embodiments, more walls, partitions, dividers, and the like may be included with at least one of the inner and outer cabinets 60 and 50. All such construction variations are intended to fall within the spirit and scope of the present disclosure.

The temperature controlled display device 10 defines a plurality of ducts (e.g., channels, pipes, conduits, air ducts, etc.) for circulating chilled air. As shown and generally speaking, the outer rear wall 54 and inner rear wall 64 define or form a rear duct 20. More particularly, a divider 63 (e.g., wall, partition, panel, barrier, etc.) and the inner rear wall 64 define or form the rear duct 20. A panel 65 is situated between the divider 63 and the outer rear wall 54. In one embodiment, the panel 65 is structured as an insulation panel configured to prevent or substantially prevent warmer, ambient air from transferring heat to the cooled air in the rear duct 20. As shown, the rear duct 20 is in fluid communication with the bottom duct 18. The rear duct 20 is also in fluid communication with a top duct 30. The top duct 30 is defined or formed by the outer top wall 52 and the inner top wall 62. The bottom duct 18 is defined or formed by and between the bottom wall 66 and the bottom wall 56. While shown as primarily rectangular in shape, it should be understood that any shape and size of the ducts may be used with the temperature controlled display device 10 of the present disclosure. Furthermore, in some embodiments, at least one of the bottom, rear, and top ducts 18, 20, and 30 may include one or more openings (e.g., apertures) in communication with the display area 12. When chilled air is circulated through the ducts, a portion of the chilled air may leak out of the openings into the display area 12 for additional cooling.

As mentioned above, the temperature controlled display device 10 is shown to include a bottom duct 18 located beneath the temperature controlled space 12. The bottom duct 18 may contain one or more components of the cooling system 100, such as the unit 104. In some embodiments, the cooling system 100 includes one or more additional components such as a separate compressor, an expansion device, a valve or other pressure-regulating device, a temperature sensor, a controller, a fan, and/or various other components commonly used in refrigeration systems, any of which may be stored within the bottom duct 18. Alternatively, the aforementioned described components may be disposed in other ducts (e.g., 20 and/or 30), in another location of the temperature controlled display device 10, or remote from the device 10. All such variations are intended to fall within the scope of the present disclosure.

Figure 2:
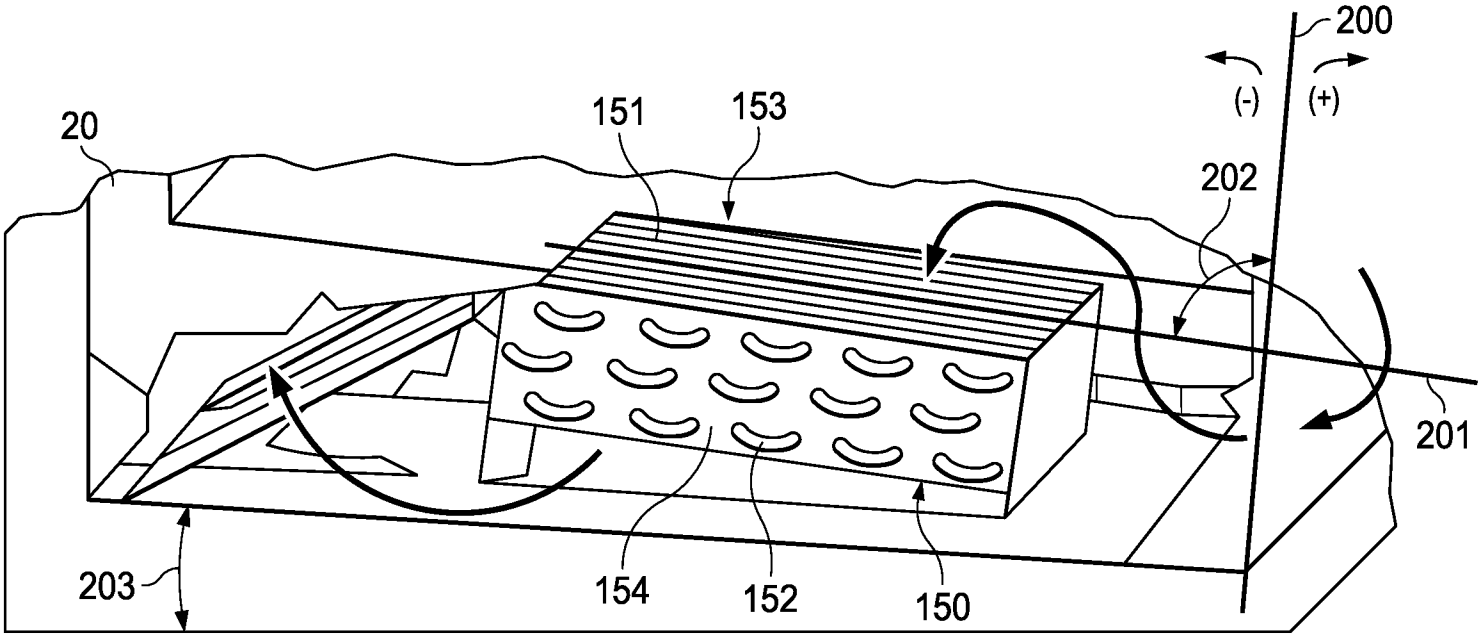
FIG. 2 is a close-up view of the heat exchanger of FIG. 1, according to an exemplary embodiment.
Figure 3:
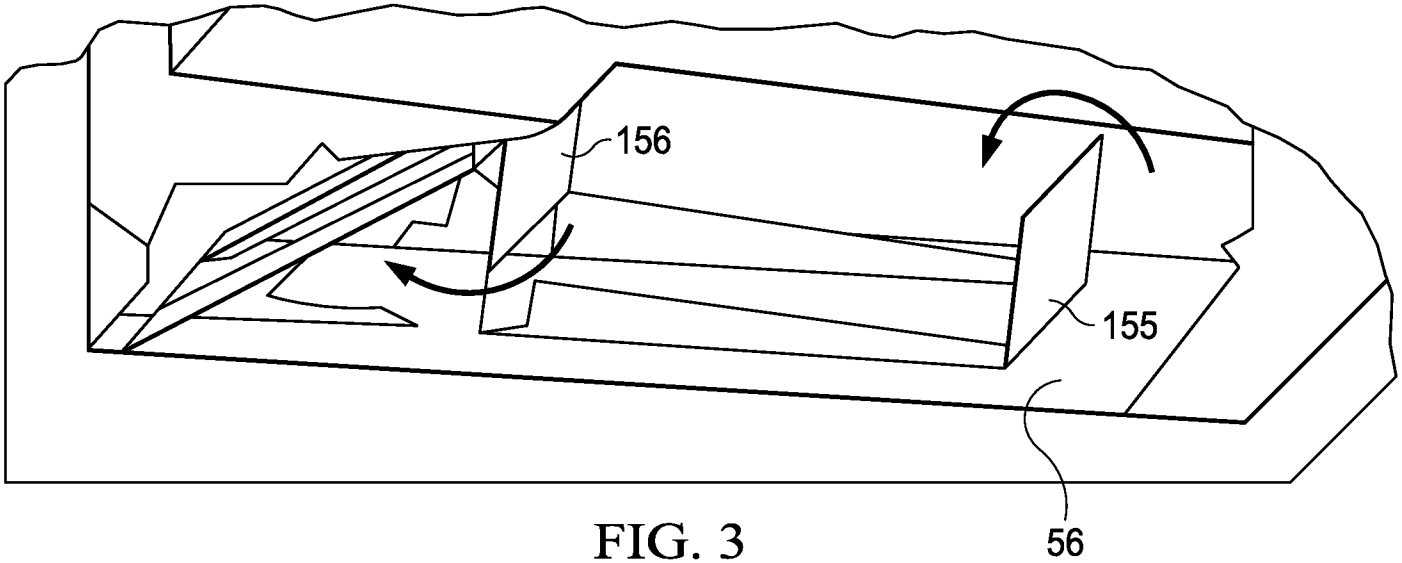
FIG. 3 is a side perspective view of the heat exchanger of FIG. 1 showing the blocking mechanisms for the secondary intake and outlet faces with the cooling coil and heat transfer fins removed from the heat exchanger, according to an exemplary embodiment.

With the above in mind and referring now collectively to FIGS. 2-3, the heat exchanger 150 of FIG. 1 with the fan 106 removed is shown according to an exemplary embodiment. As mentioned above and in this configuration, the heat exchanger 150 is a part of a direct exchange cooling system 100. In this regard, the heat exchanger 150 is structured to remove heat from the circulated air in order to maintain or substantially maintain a desired temperature of the temperature controlled space. Further and in this configuration, the heat exchanger 150 is disposed within the bottom duct 18.

As shown, the heat exchanger 150 includes heat transfer fins 151, a cooling coil 152, a primary intake face 153, a primary outlet face 154, a secondary intake face wall or other blocking mechanism 155 coupled to the secondary intake face (not shown), and a secondary outlet face wall or other blocking mechanism 156 coupled to the secondary outlet face (not shown). The heat transfer fins 151 are structured to receive the cooling coil 152 to form a fin-coil unit. The heat transfer fins 151 are structured to increase the thermally conductive heat transfer surface area of the heat exchanger 150 in order to absorb a relatively greater amount of heat from the temperature controlled space 12. Accordingly, the heat transfer fins 151 may be constructed from any type of heat conductive material (e.g., aluminum, etc.). In the example shown, the heat exchanger 150 is constructed from copper tubes (the coils 152) and aluminum fins 151. However, a variety of other construction materials may be utilized such that this arrangement is not meant to be limiting (e.g., aluminum tubes and aluminum fins, etc.). In the example depicted, the heat transfer fin 151 is shaped as a substantially rectangular shaped plate. Further, the spacing between each adjacent fin 151 in the plurality of heat transfer fins 151 is substantially equal in value. However, in other embodiments, the size, shape (e.g., square, etc.), and thickness of each fin, as well as spacing between adjacent fins may vary to accommodate various applications. All such variations are intended to fall within the spirit and scope of the present disclosure.

As shown, the heat exchanger 150 is structured as a rectangular cube or rectangular-shaped body having a rectangular cross-sectional shape like shown in FIGS. 2-3. In other embodiments, the heat exchanger 150 has a square cross-sectional shape, or rhomboid cross-sectional shape. In yet other embodiments, a different cross-sectional shape may be used with the heat exchanger 150. The rectangular cubic structure includes six sides or faces (front, back, top, bottom, left, and ride sides or faces). In this arrangement, the left and right faces represent the longitudinal ends of the heat exchanger 150 (thus, the left face is shown in FIGS. 1-3 as the face that is orthogonal when viewing FIGS. 2-3 and the right face is not shown)(i.e., the left face is where the coils 152 are shown based on the viewpoint in FIGS. 2-3). The left and right faces may engage with the housing 11 in a fluid tight manner to prevent circulated air from going around the left and right sides of the heat exchanger 150. In other embodiments, a non-fluid tight arrangement may exist, which permits at least some circulated air to go around the heat exchanger 150 (i.e., between the side of the duct 18 and the longitudinal ends of the heat exchanger 150).

As mentioned above, the heat exchanger 150 includes a primary intake face 153, a primary outlet face 154, a secondary intake face blocking mechanism 155, and a secondary outlet face blocking mechanism 156. The term "intake" when used with the faces of the heat exchanger 150 refers to an inlet or entry point for the air upstream of the heat exchanger 150. In contrast, the term "outlet" when used with the faces of the heat exchanger 150 refers to an outlet or exit point for the air that has passed through the heat exchanger 150. In turn, the "primary" face refers to the largest face (e.g., greatest surface area), while the "secondary" face refers to a relatively smaller face (e.g., a smaller surface area). With the above in mind, the primary intake face 153 is the vertically top face of the heat exchanger 150, which is proximate the temperature controlled space 12. The primary outlet face 154 is the opposite face relative to the primary intake 153 of the heat exchanger 150. Due to the rectangular cross-sectional shape, the primary intake face 153 has the same or substantially the same surface area as the primary outlet face 154.

In this example, the secondary intake and outlet faces are blocked by the blocking mechanisms 155 and 156. The blocking mechanisms 155, 156 (e.g., walls, covers, shrouds, etc.) perform two functions: i) control where the air may be received (the intake) and discharged (the outlet), and ii) control, at least partly, how the air flows within the duct that houses the heat exchanger 150. With respect to the present example, the blocking mechanism 155 covers or blocks the secondary intake face, which as a result, prevents intake air or substantially prevents intake air from entering the heat exchanger 150 via the secondary intake face. Similarly, the blocking mechanism 156 prevents or substantially outlet air from leaving the heat exchanger 150.

In the example shown, the blocking mechanisms 155 and 156 cover all or mostly all of the secondary intake and outlet faces, such that intake air cannot pass around the blocking mechanisms 155, 156 in an inlet or outlet manner. In other embodiments, the blocking mechanisms 155, 156 may define one or more openings (e.g., slits, circular holes, etc.) and/or be constructed smaller than the size of the secondary intake and outlet faces. In still other embodiments, the positioning of the blocking mechanisms 155, 156 may be coupled to different faces than what is depicted (e.g., only a blocking mechanism on the secondary outlet face, only a blocking mechanism on the primary outlet face, etc.). In yet other configurations, no blocking mechanisms may be used. In still further configurations, some combination of the above alternative arrangements may be implemented (e.g., a smaller secondary intake face blocking mechanism than the secondary intake face and no blocking mechanism on any of the intake faces, etc.). As will be appreciated, such configurations will affect the amount and how intake air is received by the heat exchanger 150, the amount and how intake air circulates through the heat exchanger 150, and the amount and how the outlet air leaves the heat exchanger 150.

In the example shown, the heat exchanger 150 is coupled to the housing 11, particularly the panels that define the bottom duct (e.g., bottom wall 56). More particularly, the heat exchanger is rotated and then coupled to the housing 11 in the bottom duct 18. Because the duct 18 also has a rectangular cross-sectional shape (based on the viewpoint depicted in FIGS. 1-3), rotating the heat exchanger 150 and then coupling the heat exchanger 150 to the housing 11 in the duct 18 functions to rotate the faces of the heat exchanger relative to the duct 18. In turn, at least one face, particularly the primary intake face 153 and primary outlet face 154, are positioned at a non-perpendicular angle relative to the air flow direction immediately upstream of the heat exchanger 150 in the duct 18. Additionally, the at least one face is also in a non-parallel relationship with the walls 56 and 66 that define the lower duct 18. For example, the lower wall 66 associated with the lowest vertical surface in the temperature controlled space is at a non-parallel relationship with the primary intake face 153 (i.e., the plane 201 associated with the primary intake face 153 is non-parallel to a parallel plane associated with the panel 66).

In this regard and despite the heat exchanger 150 having a rectangular external and overall shape, coupling of the heat exchanger 150 to at least one panel in the duct 18 is done to rotate the orientation of the heat exchanger 150 such that at least one face is at or substantially at a non-perpendicular angle relative to the air flow direction in the duct 18 immediately upstream of the heat exchanger 150. Coupling of the heat exchanger 150 in this manner may be done via a variety of different methods: for example, different sized legs or brackets may be used to change or control the relative heights of an end of the heat exchanger proximate the vent 72 (i.e., the intake air side) versus the outlet side proximate the rear duct 20; the legs may be adjustable in height (e.g., via a threaded rod, etc.) such that technicians or other personnel can adjust the relative heights of all the legs to control and modify after installation the orientation of the heat exchanger 150 in the duct 18; etc. It should be understood that similar types of coupling mechanisms may be used when the heat exchanger 150 is disposed in another, non-lower horizontal duct of the temperature controlled case 10, such as the rear vertical duct 20. In each scenario, changing or controlling the position of the heat exchanger 150 relative to the ducts that house the heat exchanger 150 enables the at least one face to be at a non-perpendicular angle relative to the air flow direction immediately upstream of the heat exchanger 150.

In this regard and as shown, the primary air intake face 153 of the heat exchanger 150 is at a non-perpendicular angle relative to the upstream air flow direction in the duct 18. Conventionally, intake faces of heat exchangers are disposed perpendicular to the upstream air flow direction. Applicant has determined many advantages of disposing the primary air intake face among other faces of the heat exchanger non-perpendicular to the air flow direction immediately upstream of the heat exchanger. In this regard, the phrase "non-perpendicular to the air flow direction immediately upstream of the heat exchanger" means that the mentioned face (e.g., primary intake face, etc.) is oriented at a non-perpendicular angle to the air flow direction within the duct immediately upstream of the heat exchanger. The air flow direction can be determined by the overall orientation of the relevant duct. For example, the duct 18 is a substantially horizontal oriented duct such that the substantially horizontal direction is the air flow direction. In contrast, the duct 20 is a substantially vertically-oriented duct, such that the air flow direction is substantially vertical in nature. In some embodiments, the duct may be purely horizontal or vertical, such that the air flow in these ducts is at an angle and the at least one face of the heat exchanger is moved or rotated to be non-perpendicular to this air flow direction. This definition excludes any air flow changes of direction that may occur when, e.g., the air flow enters the duct housing the heat exchanger. Additionally, "non-perpendicular" means an angle between and including zero (0) degrees to eighty-nine (89) degrees, where "approximately" in this context means+/−0.5 degrees.

Therefore and based on the view shown in FIGS. 1-3, circulated air enters the duct 18 via the vent 72, which as shown means the air goes from a downward vertical direction to a leftward horizontal direction. Thus, the transition is not used to determine non-perpendicularity; rather, the immediate upstream air flow direction is parallel to the orientation of the lower wall 56, which is perpendicular to the plane 200. In this example, the orientation of the lower wall 56 is at an angle 203 relative to a horizontal plane. In the depicted embodiment, the angle 203 is approximately three (3) degrees. Beneficially, by placing the lower wall 56 at this angle as opposed to being perfectly horizontal, drainage of various items in the duct 18 (e.g., defrost water, spilled food merchandise, liquids used when cleaning the case, etc.) is promoted (e.g., to a waste outlet pipe). This slope is known as a drainage slope. Turning back to heat exchanger 150, a plane 201 is provided parallel to the primary intake face 153 (more particularly, coplanar with the intake face 153), which is shown to intersect the plane 200 at an angle 202. In the example shown, the plane 201 forms an approximate five (5) degree angle relative to a horizontal plane. As such, the angle 202 is non-perpendicular relative to the plane 200, which is perpendicular to the air flow direction immediately upstream of the heat exchanger 150. In the example shown, the angle 202 is approximately eighty-eight (88) degrees. In other embodiments, a different non-perpendicular angle may be implemented with the primary intake face 153 relative to at least one of the plane that is perpendicular to the air flow direction immediately upstream of the heat exchanger 150 or to a panel/wall that defines the duct (e.g., walls 56 or 66). In this regard, the angle of the primary intake face 153 relative to the horizontal plane may vary in other implementations (e.g., ten degrees, fifteen degrees, etc.) (a different angle relative to the horizontal plane than five (5) degrees). As such, the angle 202—the angle between the plane 201 that is coplanar to the primary intake face 153 and the plane 200 that is perpendicular to the immediate upstream air flow direction—can vary greatly in different embodiments. Turning back to the heat exchanger 150 and due to the rectangular overall shape of the heat exchanger 150, each of the opposite-oriented faces of the heat exchanger (e.g., primary intake face 153 and primary outlet face 154) are parallel to each other. As such, each face in each pair of parallel faces is at the same angle relative to the upstream air flow in the duct 18.

In the example shown, the primary intake face 153 is at a non-perpendicular angle, shown as angle 202, to the air flow direction immediately upstream to the heat exchanger 150 in the duct 18. In particular, the angle 202 of the primary intake face 153 is "negative" relative to the plane 200 that is perpendicular to the upstream air flow direction that is immediately upstream of the heat exchanger 150. In this regard, "negative" and "positive" refer to how the face is oriented with respect to the plane that is perpendicular to the immediate upstream air flow direction relative to the heat exchanger in the duct (in this example, plane 200) whereby "negative" refers to the face being oriented away from the perpendicular plane and "positive" refers to the face being oriented towards the perpendicular plane. Here, the primary intake face 153 is at a "negative" angle 202. In this regard and relative to a horizontal plane, the primary intake face 153 is at an approximate one-hundred and seventy-two (172) degree angle (172=180 degrees minus (5 degrees for the angle of the plane 201 relative to a horizontal plane plus 3 degrees for the angle of the lower wall 56 relative to the horizontal plane)). In comparison and if the blocking mechanism 155 were removed from the secondary intake face, the secondary intake face would be at a positive angle relative to the perpendicular plane. All variations of positive and negative angles for all of the faces of the heat exchanger are intended to fall within the spirit and scope of the present disclosure.

With the above in mind, operation of the heat exchanger 150 in connection with the cooling system 100 and the benefits associated therewith may be described as follows. As heat is removed from the surrounding air via the heat exchanger 150, the surrounding air is chilled. While the chilled air may be directed to temperature controlled space 12 by at least one air mover or another air flow device (e.g., fan 106), the chilled air may also be circulated through the ducts 18, 20, and 30 by the fan 106. Via the motive force from the fan 106, the chilled air is first directed, guided, forced, otherwise pushed or moved to the rear duct 20. The rear duct 20 guides the chilled air to the top duct 30. The top duct 30 guides the chilled air to a discharger 70. The discharger 70 (e.g., diffuser, etc.) provides or discharges the chilled air to form or at least partially form an air curtain 80. At least part of the air in the air curtain 80 may be received by a receptacle, shown as a vent 72 that is in fluid communication with the bottom duct 18. The received air may then be pushed to the heat exchanger 150 by the fan 106. The pushed air impacts the secondary face blocking mechanism 155. Due to the blocking mechanism 155 and lower wall 56 of the bottom duct 18 engaging to form a substantially fluid-tight seal, the pushed air is forced to move upwards towards the upper wall 66 (i.e., towards the temperature controlled space 12). The upward moving air may then impact the upper wall 66 (i.e., the surface proximate the heat exchanger 150), which redirects the air towards the primary air intake face 153. However, some of the upward moving air may simply migrate to the primary air intake face 153 without impacting the upper wall 66. In any event, this air is received by the heat exchanger 150 via the intake face 153, such that heat is removed from the air received by the heat exchanger 150. The cooled air is then discharged via the primary outlet face 154. In this example, the discharge direction is towards the lower wall 56. The discharged chilled air may either impact the lower wall or not; in either case and due to the motive force, the chilled air is then directed to the rear duct 20. In this example, each of the intake face 153 and discharge face 154 is at a non-perpendicular angle relative to the air flow direction immediately upstream of the heat exchanger 150.

In the example depicted, the heat exchanger 150 includes a primary intake face of 12.75", which is disposed in the duct 18 with a smaller 6.5" height (from the surface of the lower wall 66 proximate the heat exchanger 150 to the surface of the wall 56 proximate the heat exchanger 150). Thus, a length of the face 153 is longer than a vertical height of the duct 18. More generally and as described herein, the cross-sectional length (the length of the face 153 that is shown in FIG. 2 as contrasted with the length that goes into the page of FIG. 2) of the primary intake face of the heat exchanger is greater than the cross-sectional height (in the case of a heat exchange positioned in a horizontal duct) or width (in the case of the heat exchanger positioned in a vertical duct) of the duct that receives the heat exchanger. The height and widths of the ducts relative to the length of the primary intake faces are shown in the FIGURES herein. As mentioned above, panels (blocking mechanisms 155 and 156) were installed to block air flow on the short/secondary intake/outlet faces (3.25") sides of the heat exchanger and to direct the air flow through the larger (12.75") primary intake and outlet 153 and 154 faces. As mentioned above, this configuration was oriented at a 5-degree angle from the duct structure formed between the lower wall and upper wall of the duct 18 (thus, an 8-degree angle relative to the horizontal plane due to the 3-degree drainage slope angle). Based on the aforementioned operational description, the heat exchanger 150 was oriented to intake air flow from vertically above and have the air flow exit towards the bottom wall (a vertically downward direction based on the viewpoint in FIGS. 2-3), where the air flow turned to move rear ward and again parallel to the duct 18.

A first advantage is that the duct dimension that houses the heat exchanger no longer constrains the intake face dimension of the heat exchanger. The intended primary air intake face can thus be increased to a dimension greater than the non-shopped duct cross-sectional height/dimension in which the heat exchanger resides (i.e., the vertical height of the duct from the lower wall to the upper wall). A larger intake face reduces the overall air flow-resistance of a heat-exchanger versus a typical heat exchanger. A second advantage is that the lowered air flow resistance reduces energy consumption of the air-mover, such as the fan 106, which generates the pressure differential circulating the air. Additionally, fans generate unwanted heat energy within the refrigerated space, so reduced fan energy can in turn lower the refrigeration demand.

A third advantage is that the larger intake face compared to conventional heat exchangers increases robustness of the heat exchanger versus ice accumulation. In operation, air entering the heat exchanger contains moisture entrained from the ambient which is preferentially attracted to the cold surfaces of the heat exchanger. The moisture collects as ice crystals on the heat exchanger operating at or below the freezing-point of water. As the ice grows in thickness it creates an insulating barrier between the heat exchanger and air flow, thereby diminishing heat transfer efficiency. Simultaneously, the ice growth reduces the space between heat exchanger passageways and increases the air flow resistance, which increases energy consumption of the fan or other air-mover. To address the ice accrual, manufacturers create defrost schedules for their refrigerated display cases and the heat-exchanger therein. Beneficially, the heat exchanger of the present disclosure can be designed for a certain lowered pressure drop that enables overall lowered air-velocity in the display case, thereby entraining less moisture into the refrigerated air-curtain by choosing a non-perpendicular angle of the primary air intake face relative to the air flow immediately upstream of the heat exchanger. In this regard and for heat exchangers that are otherwise constructed the same, and which encounter the same air volume moving at similar air-velocity with same moisture content, the larger intake face of the heat exchanger of the present disclosure has a slower rate of ice accumulation because the same moisture content is distributed over a larger intake face. Due the slower ice accumulation rate, the heat exchanger of the present disclosure may be operated longer between defrost cycles or be given defrosts as frequently as a conventional heat exchanger but for a shorter time duration. Either method sums to a lower amount of total defrost time per twenty-four hour period. Lowered overall defrost time is desirable since the refrigeration is shut off during defrost cycles and the entire case drifts warmer in temperature, though at a different rate from the localized heat exchanger area. The shorter overall amount of defrost time may disturb product temperature less plus allow the temperature controlled case to pull temperatures down more efficiently upon re-entering refrigeration (it is quicker and requires less energy to re-obtain the desired refrigeration set-point having started from a less disturbed, colder temperature at end of defrost).

A related fourth advantage is that the heat exchanger 150 is then more resistant to ice accumulation and, in turn, is more flexible and desirable for an end user. For example, the temperature controlled case 10 and heat exchanger 150 may be configured with extra resistance to ice-accumulation as a means to offer a broader operating range in order to perform in harsh environments (e.g., stores with elevated ambient humidity levels or greater shopping traffic, which cause higher moisture levels in the return air). As another example, the heat exchanger might be configured for a broader range of application set-points thereby allowing the conversion of a case to display different product types (e.g., a case originally used for dairy may be reconfigured and capable to cool fresh meat should a user determine later need for more meat display in the store).

A fifth advantage is that the minimization of non-shopped areas (i.e., the duct containing the heat exchanger) improves the ratio of usable refrigerated display to the overall temperature controlled case size. As an example, for a heat exchanger of the present disclosure mounted in a rear wall vertical duct, a size reduction in the duct may reduce the amount of required floor space for the temperature controlled case (see FIG. 6 discussed below). For a heat exchanger of the present disclosure mounted in a horizontal duct (like in FIGS. 1-5), the overall temperature controlled case size may be unchanged but the temperature controlled space 12 size may be increased. Additionally, a reduction in the size of the horizontal duct may allow the equipment maker to vertically translate and lower a front sill height and perishable display deck(s) by the same amount as the duct reduction. This may promote easier product access for store workers, consumers (especially disabled individuals), and provide bettered product viewing.

Figure 4:
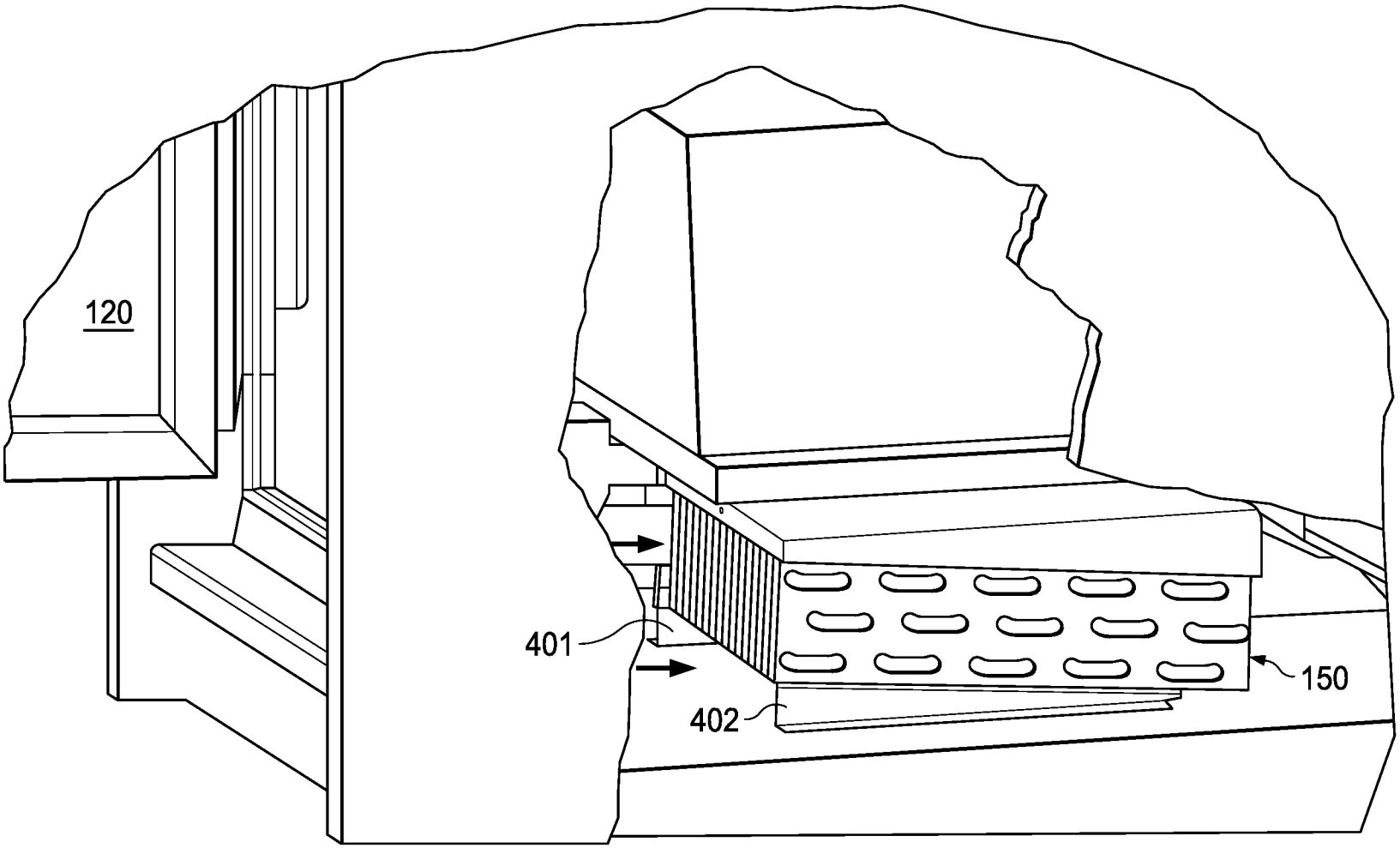
FIG. 4 is a perspective view of a heat exchanger for a temperature controlled case with an induced air flow, according to an exemplary embodiment.
Figure 5:
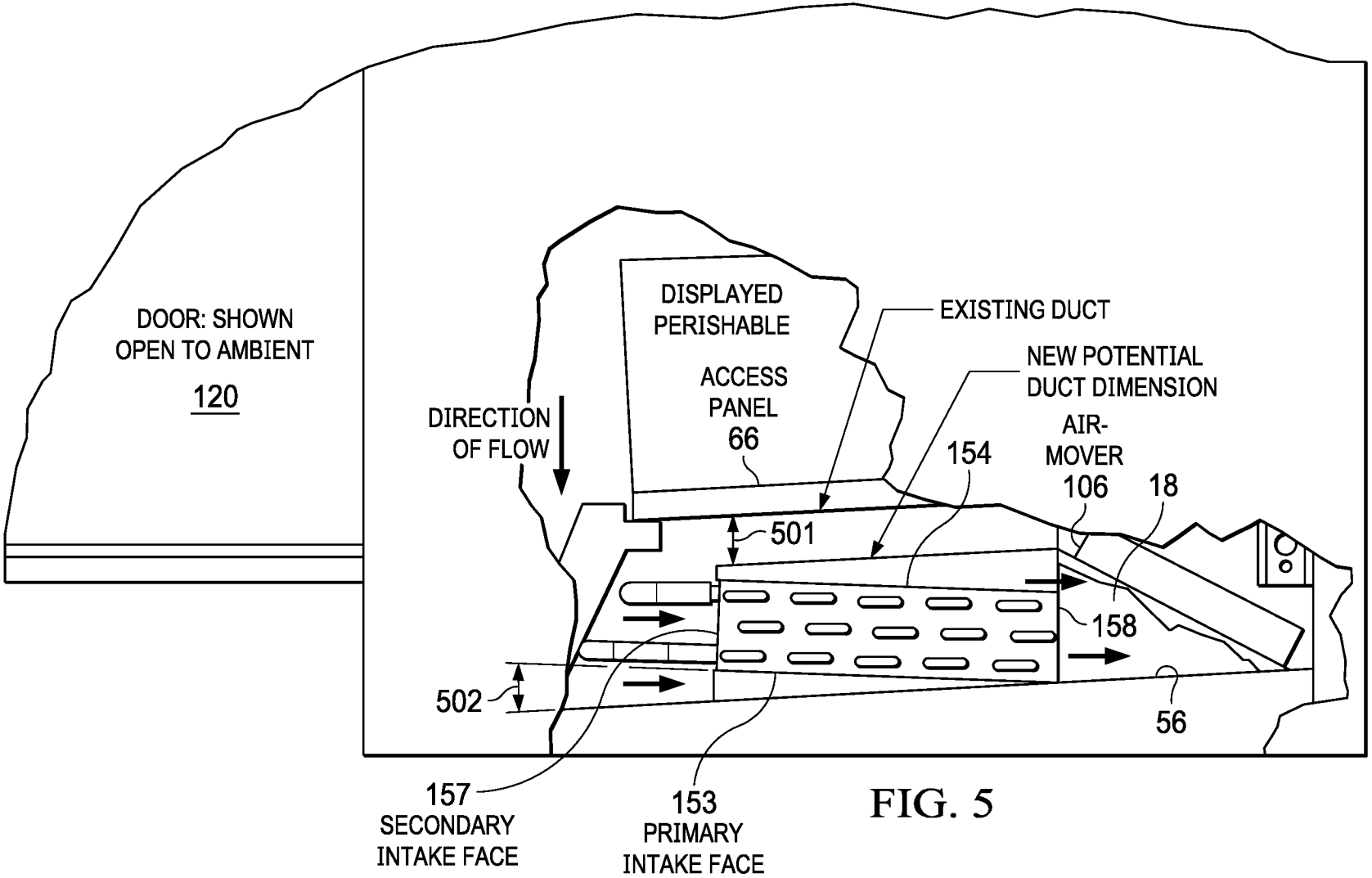
FIG. 5 is a side view of the heat exchanger of FIG. 4, according to an exemplary embodiment

Referring now to FIGS. 4-5, the heat exchanger 150 is disposed in a lower horizontal duct 18 of a closed-front temperature controlled case 10, according to exemplary embodiments. The configuration in FIGS. 4-5 is identical to that shown in FIGS. 1-3 except for the blocking mechanisms being removed and the differences described below. As shown, the heat exchanger 150 includes a primary intake face 153, a primary outlet face 154, a secondary intake face 157, and a secondary outlet face 158. Like in FIGS. 1-3, an induced air flow configuration is shown in FIGS. 4-5 (i.e., the fan 106 is disposed downstream from the heat exchanger 150). As shown, a pair of brackets 401 and 402 (e.g., feet, braces, support structures, etc.) couple the heat exchanger 150 to the housing 11, particularly the inner surface of the bottom wall 56, within the bottom horizontal duct 18. The brackets 401 and 401 are shown to have a height that varies longitudinally in order to dispose the primary intake face 153 at a non-perpendicular angle to the air flow direction immediate upstream of the heat exchanger 150. In this configuration, the primary air intake face 153 is disposed at an approximate five (5) degree angle relative to the inner surface of the bottom wall 56. This shown as angle 502. In this regard, the air flow in the horizontal duct 18 is a horizontal direction, such that the primary intake face 153 is at a non-perpendicular angle relative to the air flow direction in the duct 18. Of course and as described above, in other embodiments, different coupling mechanisms may be utilized to control the orientation of the heat exchanger 150 within the duct 18 (i.e., to be at different angles other than five degrees).

The air flow through the heat exchanger 150 of FIGS. 4-5 differs from that depicted in FIGS. 1-3. In this regard, no blocking mechanisms are utilized to block one or more intake/outlet faces. Further, intake air is directed vertically downward and toward the bottom wall 56 where it then is directed vertically upward toward the face 153. Simultaneously, intake air can also be received by the secondary intake face 157. The air is chilled through the heat exchanger 150 and discharged via the primary outlet face 154 towards the upper wall 66 and via the secondary outlet face 158. Applicant has determined that the addition of the faces previously blocked in FIGS. 1-3 as a secondary intake and secondary outlet faces 157 and 158 is a viable configuration capable of transferring heat from the moving air to the heat exchanger 150. The further advantage of this configuration is that the multiple intake faces increase the effective intake face dimension. Using the same sizes of the faces of the heat exchanger in FIGS. 1-3 and because both the primary (12.75") and secondary (3.25") intake faces are active (i.e., able to receive intake air), this configuration has a relatively larger intake face surface area compared to that of FIGS. 1-3 (i.e., 16" total intake dimension). In this configuration, the air stream can continue to maintain a vector direction parallel to the duct 18 while going through the heat exchanger 150. That said, the primary intake face 153 remains at a non-perpendicular angle to the upstream air vectors, and as mentioned above, in this configuration crosses the primary intake face at direction 5-degrees from parallel.

With reference to FIG. 5, a decrease in duct dimension height 501 is shown. In this regard and as mentioned above, positioning the primary air intake face of the heat exchanger at a non-perpendicular angle relative to the air flow direction immediately upstream from the heat exchanger may enable decreasing the size of the duct that houses the heat exchanger. This size reduction is shown by reference number 501 in FIG. 5.

Figure 6:
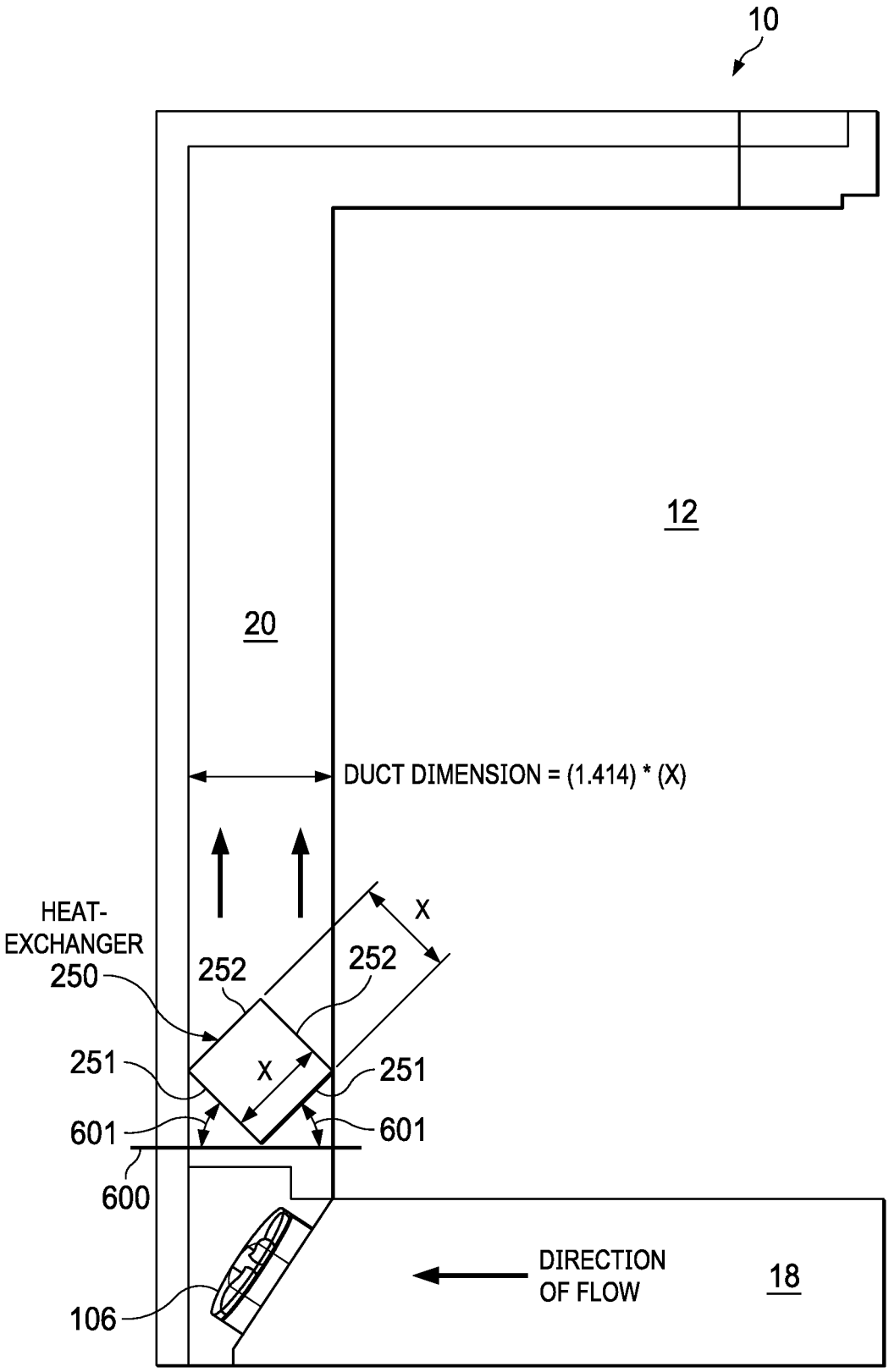
FIG. 6 is a side view of a heat exchanger disposed behind a vertical panel in a rear air duct in a vertically-oriented temperature controlled case, according to an exemplary embodiment.

Referring now to FIG. 6, a heat exchanger disposed in the rear vertical duct 20 in a vertically-oriented temperature controlled case 10 is shown, according to an exemplary embodiment. The temperature controlled case 10 may have a similar configuration to that which is shown in FIGS. 1-5. However, here, the heat exchanger 250 is disposed in the back vertical duct 20 and the fan 106 is disposed upstream of the heat exchanger 250. Thus, a forced air relationship is provided in the temperature controlled case 10 of FIG. 6.

The heat exchanger 250 may have a similar configuration as the heat exchanger 150. In this regard, the cooling system of the temperature controlled case 10 of FIG. 6 may be a direct expansion cooling system, such that a similar function may be implemented with the heat exchanger 250. However, a different reference number is used to denote a different structure that is implemented with the heat exchanger 250 in order to couple the heat exchanger 250 vertically in the duct 20.

As shown, the heat exchanger 250 includes a pair of primary intake faces 251 and a pair of primary outlet faces 252. In this regard, the cross-sectional length (as shown in FIG. 6) of each face in each pair is equal or substantially equal to each other. In other embodiments, different lengths may be implemented with the four intake/outlet faces. Further, blocking mechanisms, like blocking mechanisms 155 and 156, may also be coupled to one or more faces. In the example shown, no blocking mechanisms are used with any of the intake/outlet faces.

As shown, each of the intake and outlet faces 251 and 252 is at a non-perpendicular angle relative to the air flow direction immediately upstream to the heat exchanger 250, which is perpendicular to the horizontal plane 600. In particular, the each of the intake faces 251 is at an angle 601 relative to the plane 600, whereby the plane 600 is perpendicular to the air flow direction immediately upstream of the heat exchanger 250. In the example depicted, the angle 601 is approximately equal to forty-five (45) degrees, where approximately is equal to +/−0.5 degrees. Based on Applicant's research, the heat exchanger can be just as effective whether the primary intake face is between the insulated wall and the airstream (i.e., the left "X") versus from the air stream to the metal panels that separate the duct from the shopped space.

The heat exchanger embodiments of the present disclosure are applicable across a wide range of equipment that circulates air to maintain a desired temperature of a refrigerated space. As example, single display deck cases, cases with multiple display decks, cases with doors (whether vertical, horizontal, or at another angle), and open-cases all could derive benefits from the heat exchanger embodiments of the present disclosure. The heat exchanger embodiments of the present disclosure are applicable whether the heat exchanger and duct are in a vertical plane (e.g., FIG. 6), a nominally horizontal plane (e.g., FIGS. 1-5), and/or any other orientation or area of the case. The heat exchanger embodiments of the present disclosure can be used independent of, or in conjunction with, other existing technologies such as multiple air-curtains, single air curtains, and structures that direct outlet air flow to certain areas of the shopped/temperature controlled space or certain sub-ducts of the case. Moreover, the heat exchanger embodiments of the present disclosure apply regardless of the number of heat exchangers within the temperature controlled case or cases (i.e., one large heat exchanger versus multiple smaller heat exchangers). The fan(s), or other air movers, may be installed upstream the heat exchanger (forced air)(e.g., FIG. 6), downstream from the heat exchanger (induced air flow at heat-exchanger)(e.g., FIGS. 1-5), or in multiple locations before, after, or both before and after the heat exchanger embodiments of the present disclosure. Air movers may be installed in a section of intersecting duct that communicates the air flow to or from the duct section housing the heat exchanger. As an example, FIG. 6 depicts a case where the upstream air mover resides in a horizontal duct at case bottom (i.e. from insulated tank to display deck panels) and the air mover forces air around a turn in the duct work and into an intersecting duct section that runs vertically. The heat exchanger resides within the vertical duct section (between insulated rear wall and metal baffles that define rear of the shopped space). As described above, the heat exchanger may be deployed with the primary intake face oriented at either a positive or negative rotation angle from the upstream airflow.

It should be understood that the terms "refrigerant" and "coolant" are used interchangeably herein. In this regard, Applicant contemplates that a wide variety of coolant or refrigerant types may be used with the heat exchanger of the present disclosure.

It should be noted that references to "front," "rear," "upper," "top," "bottom," "base," and "lower" in this description are merely used to identify the various elements as they are oriented in the Figures. These terms are not meant to limit the element which they describe, as the various elements may be oriented differently in various embodiments.

Further, for purposes of this disclosure, the term "coupled" or other similar terms, such as "attached," means the joining of two members directly or indirectly to one another. Such joining may be stationary in nature or moveable in nature and/or such joining may allow for the flow of fluids, electricity, electrical signals, or other types of signals or communication between the two members. Such joining may be achieved directly with the two members or the two members and any additional intermediate members being attached to one another and the two members. For example and for the purposes of this disclosure, component A may be referred to as being "coupled" to component B even if component C is an intermediary, such that component A is not directly connected to component B. On the other hand and for the purposes of this disclosure, component A may be considered "coupled" to component B if component A is directly connected to component B (e.g., no intermediary). Such joining may be stationary or moveable in nature. Such joining may be permanent in nature or alternatively may be removable or releasable in nature.

It is important to note that the construction and arrangement of the elements of heat exchanger provided herein are illustrative only. Although only a few exemplary embodiments of the present disclosure have been described in detail in this disclosure, those skilled in the art who review this disclosure will readily appreciate that many modifications are possible in these embodiments without materially departing from the novel teachings and advantages of the disclosure. Accordingly, all such modifications are intended to be within the scope of the disclosure.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present disclosure as expressed in the appended claims.

What is claimed is:

1. A temperature controlled case, comprising:

a housing that defines a temperature controlled space, the housing including a duct that receives circulated air, the duct having a lower wall oriented at a first angle from horizontal;

a support structure coupled to the lower wall of the housing, the support structure having a height that varies longitudinally and a length;

a heat exchanger coupled to the housing via the support structure, the heat exchanger coupled to the support structure along the length of the support structure, the heat exchanger disposed within the duct at a second angle from the lower wall and at a third angle from horizontal that is greater than the first angle, the heat exchanger including a primary intake face, a secondary intake face adjacent the primary intake face, a primary outlet face positioned on an opposite side of the heat exchanger relative to the primary intake face, and a secondary outlet face positioned adjacent the primary outlet face, where the height of the support structure angles each of the primary intake face, the secondary intake face, the primary outlet face, and the secondary outlet face at a non-perpendicular angle relative to an air flow direction in the duct immediately upstream of the heat exchanger, where the primary intake face is fully open to pass circulated air that is cooled by the heat exchanger before being discharged via at least one of the primary and secondary outlet faces, and the secondary intake face is at least partially open to pass circulated air that is cooled by the heat exchanger before being discharged via at least one of the primary or secondary outlet faces; and an air mover disposed downstream of the heat exchanger in the air flow direction, the air mover mounted in a panel positioned angularly within the duct to induce an airflow through the primary intake face and the heat exchanger, to the primary outlet face, and to the temperature controlled space, the panel configured to restrict the airflow from the primary outlet face through the air mover.

2. The temperature controlled case of claim 1, wherein the temperature controlled case is a vertically oriented case, and wherein the duct is positioned vertically below the temperature controlled space and with the first angle at approximately 3 degrees, and the second angle at approximately 5 degrees.

3. The temperature controlled case of claim 1, wherein the primary intake face is angled away from a plane perpendicular to the air flow direction in the duct immediately upstream of the heat exchanger.

4. The temperature controlled case of claim 1, wherein the heat exchanger is a part of one of a direct expansion cooling system or a secondary coolant cooling system for the temperature controlled case.

5. The temperature controlled case of claim 1, wherein the temperature controlled case is vertically oriented.

6. The temperature controlled case of claim 5, wherein the duct comprises a vertical duct positioned behind the temperature controlled space.

7. The temperature controlled case of claim 1, wherein the heat exchanger comprises a cooling coil, and a plurality of heat exchange fins coupled to the cooling coil, and the cooling coil and the plurality of heat exchange fins form a rectangular body having a primary intake face for receiving air that exchanges heat with the cooling coil, and the primary intake face is disposed at a non-perpendicular angle relative to a plane that is perpendicular to a direction of air flow immediately upstream of the heat exchanger.

8. The temperature controlled case of claim 1, wherein the heat exchanger further comprises a left face and a right face, the left face and the right face each coupled to the primary intake face, the secondary intake face, the primary outlet face, and the secondary outlet face.

9. The temperature controlled case of claim 8, wherein the left face and the right face are engaged with the housing to prevent the circulated air from passing around a left side and a right side of the heat exchanger.

10. The temperature controlled case of claim 1, wherein a length of the primary intake face is longer than a vertical height of the duct.

11. The temperature controlled case of claim 1, wherein a cross-sectional shape of the heat exchanger is at least one of a square, a rectangle, or a rhomboid.

12. The temperature controlled case of claim 1, wherein the panel comprises an aperture into which the air mover is mounted.

13. The temperature controlled case of claim 12, wherein the aperture is centered in the panel.

14. The temperature controlled case of claim 13, wherein the panel is positioned angularly within the duct from an edge of the heat exchanger to an interior surface of the duct.

15. The temperature controlled case of claim 1, wherein the panel is positioned angularly within the duct from an edge of the heat exchanger to an interior surface of the duct.

16. The temperature controlled case of claim 15, wherein the panel comprises an aperture into which the air mover is mounted.

17. The temperature controlled case of claim 1, wherein the primary intake face is oriented at an approximate five degree angle relative to an inner surface of a bottom wall of the temperature controlled case.

* * * * *